US005819353A

United States Patent [19]

Armell et al.

[11] Patent Number: 5,819,353

[45] Date of Patent: Oct. 13, 1998

[54] TOOL FOR CLEANING OR CONDITIONING TUBULAR STRUCTURES SUCH AS WELL CASINGS

[75] Inventors: Richard Alvin Armell, Angus; Giancarlo Tomasso Pietro Pia, North Danestone, both of Scotland

[73] Assignee: Oiltools International B.V., Netherlands

[21] Appl. No.: 698,450

[22] Filed: Aug. 30, 1996

[30] Foreign Application Priority Data

Sep. 1, 1995 [GB] United Kingdom ..... 9517829

[51] Int. Cl.[6] ..... E21B 37/02

[52] U.S. Cl. ..... 15/104.2; 15/104.16; 15/104.09; 15/104.05; 166/173

[58] Field of Search ..... 15/104.05, 104.09, 15/104.16, 104.2, 104.095, 104.066, 104.067, 104.068, 104.069; 166/170, 173, 241.6

[56] References Cited

U.S. PATENT DOCUMENTS

| | | | |
|---|---|---|---|
| 555,976 | 3/1896 | Secor | 15/104.16 |
| 2,248,742 | 7/1941 | Burnham | 15/104.2 |
| 3,827,492 | 8/1974 | Hammon et al. . | |
| 4,159,742 | 7/1979 | Alexander, Jr. . | |
| 4,291,764 | 9/1981 | Pampell . | |

FOREIGN PATENT DOCUMENTS

| | | | |
|---|---|---|---|
| 280737 | 11/1914 | Germany | 15/104.05 |
| 2195378 | 4/1988 | United Kingdom . | |
| 9429569 | 12/1994 | WIPO . | |

*Primary Examiner*—Randall E. Chin
*Attorney, Agent, or Firm*—Elliott N. Kramsky

[57] ABSTRACT

A tool for the cleaning and conditioning of tubular structures, such as well casings, comprises a central mandrel (1) upon which are mounted a plurality of interchangeable sleeves (4–9). The sleeves at each end bear stabilization elements enabling the tool to be used in a well casing of any disposition and the intermediate sleeves bear conditioning or cleaning elements (12) angularly spaced apart and separated by fluid channels (13), the cleaning elements of adjacent sleeves being off-set to form a substantially helical pattern of cleaning elements and channels to ensure 360° of coverage as a tool is axially displaced within a well casing. The sleeves are mounted in such a way that relative rotation between them and the mandrel is prevented by a combination of keyways and of drive faces between adjacent sleeves formed by cut-away portions.

29 Claims, 5 Drawing Sheets

TOOL FOR CLEANING OR CONDITIONING TUBULAR STRUCTURES SUCH AS WELL CASINGS

This invention relates to a tool for cleaning or conditioning tubular structures such as well casings. More particularly, it relates to a tool which is intended for being mounted on a workstring and displaced axially through a tube and which has a plurality of cleaning or scratching elements for removing debris from the interior surface of the tube or otherwise conditioning the tube.

There are numerous cleaning tools available for this purpose, each of which has some disadvantages. In particular, many pre-existing tools require additional stabilization units to be provided on the work string on which the tool is suspended. This increases complexity and the number of parts which must be maintained or repaired as necessary. Furthermore, most pre-existing tools are designed for one particular purpose, size or material of tube or well casing and a different tool must be used with each different well casing or type of cleaning job required. Another problem is that many pre-existing well cleaning or conditioning tools can only be used reliably in casings which are vertical. If the casing is more than a small angle off vertical, then it can be difficult to maintain correct angular or axial disposition of the tool with respect to the casing and this may lead to the tool getting stuck or incomplete cleaning.

The present invention arose in an attempt to provide an improved tool for use in tubes such as well hole casings.

According to the present invention there is provided a tool for conditioning the interior of a tubular structure, comprising a mandrel for connection to a workstring; and a plurality of interlocking sleeves mounted end to end along at least part of length of the structure, comprising in combination, a mandrel for connection to a workstring; a plurality of interlocking sleeves mounted end to end along at least part of the length of the mandrel; at least one of the sleeves bearing conditioning elements; at least one sleeve or the mandrel bearing a stabilization element; and means for preventing relative rotation between the sleeves and the mandrel, so that, as the mandrel rotates, the sleeves rotate therewith.

The conditioning/cleaning elements may be of any desired type, eg pins, pads, fingers, blades, and of any suitable material for performing various cleaning operations and treatments inside a tubular structure such as a well casing. In a preferred embodiment, the elements are U-shaped members, resiliently mounted in a housing.

The means for preventing relative rotation between the mandrel and sleeves in operation may comprise the sleeve each having respective drive faces at their ends for abutting against a respective drive face of another sleeve. One or more drive faces, lugs or keyways may be provided for locating one or more sleeves with respect to the mandrel.

DESCRIPTION OF THE DRAWINGS

Embodiments of the invention will now be described, by way of example only, with reference to the accompanying drawings, in which.

Figure 1:
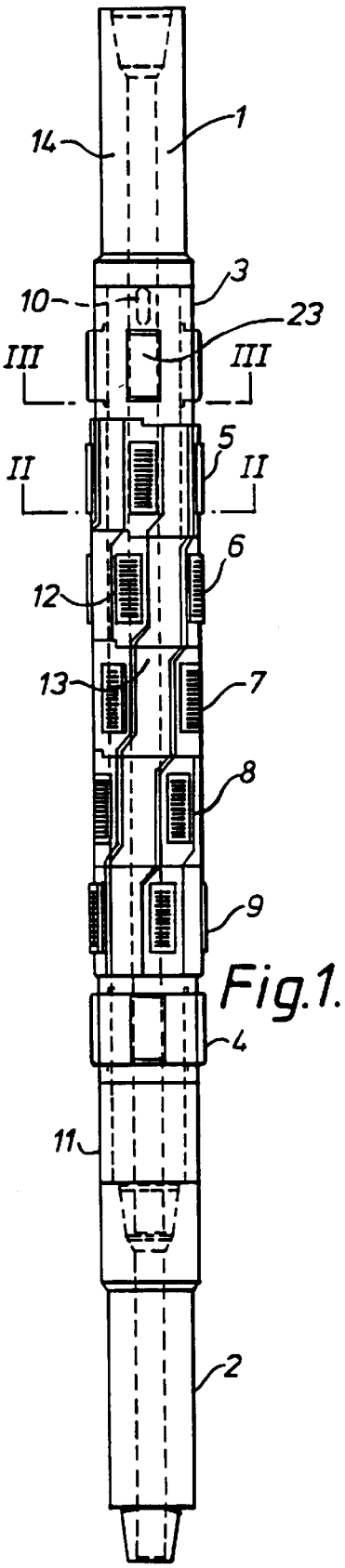
FIG. 1 shows a well cleaning or conditioning tool.

An assembled tool for cleaning or conditioning tubular structures, in particular well casings, is shown in FIG. 1 and the individual components are shown in the remaining figures. The tool comprises a central mandrel 1 connected at its lower end to a lower subshaft 2. The distal ends of the mandrel and subshaft are connected by standard API or other types of threaded connections to a work string (not shown) in conventional manner. In one embodiment, these may be 4½ in (11.4 cm) i.f or regular threads. The tool can be raised or lowered on the work string and related with the work string as is well known. Mounted on the mandrel are a plurality of cages or sleeves. In one example, these comprise an upper stabilizer sleeve 3 bearing four angularly-spaced stabilization elements 23, a lower stabilizer sleeve 4 again bearing four angularly-spaced stabilization elements and, between the two stabilization sleeves, five brush retaining sleeves 5, 6, 7, 8, 9 each bearing four angularly-spaced cleaning elements 12. More or less sleeves may alternatively be provided, and these may have more or less than four elements on each sleeve if-desired, or if necessary due to the diameter of the tool. The elements may be the same or of different sizes and types.

The sleeves all have a bore through their centre sufficient for the sleeves to be mounted coaxially over the mandrel. In one example, a keyway 10 is used to locate the upper stabilizer sleeve 3 with respect to mandrel 1 and each of the remaining sleeves are keyed into each other by a series of drive faces as described below. An additional spacer sleeve 11 is mounted below lower stabilization sleeve 4. This spacer sleeve 11 is merely a hollow cylindrical sleeve and, in combination with lower sub-shaft 2, allows the tread on the box of the mandrel to be reworked after wear, thus allowing longer utilization of the mandrel. It will be noted that all of the sleeves are individually replaceable so that if one of them becomes worn or breaks it is only necessary to replace that sleeve and not the entire sleeve assembly. Also, each element is individually replaceable within a sleeve, to repair damage or to replace an element by one of a different type.

The cleaning/conditioning elements or brushes 12 on the brush retaining sleeves are arranged four on each sleeve in this embodiment, spaced 90° apart. Longitudinally, along the length of the tube, the brushes are arranged as shown in an off-set manner so that they form a discontinuous, generally helical, pattern down part of the length of the tool. This enables substantially continuous coverage through 360° of the inner surface of a casing of a tube to be cleaned when the tool is moved axially through the tube. The tool will also preferably be rotated at the same time. Grooves or channels 13 are also formed in each cleaning/conditioning element retaining sleeve, between adjacent brushes, and these are shaped such that a continuous channel is formed along all of the cleaning/conditioning element retaining sleeves, which channel is again in a generally helical fashion. The channel enables water or cleaning fluids for example to pass along the outside of the tool, between the brushes. An internal bore 14 is formed in the mandrel and lower subshafts so that fluid can pass down through this bore and up through the channels 13, or vice-versa.

Figure 2:
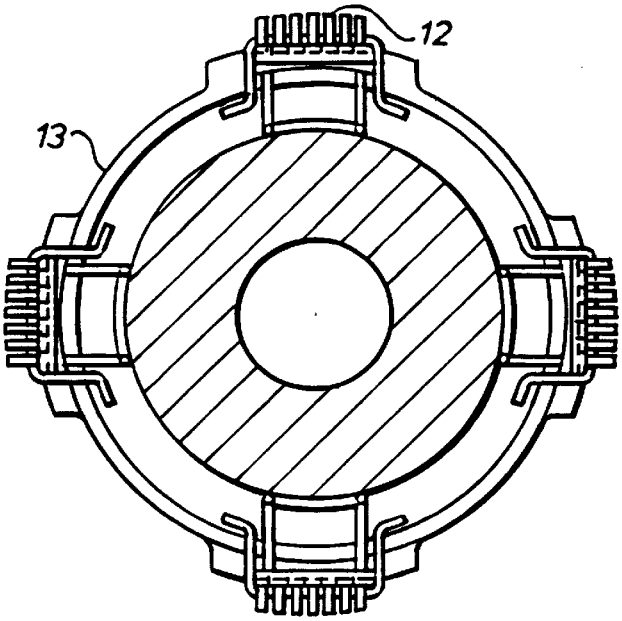
FIG. 2 shows a cross section through II—II of FIG. 1.
Figure 4A:
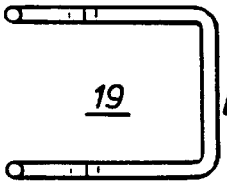
FIGS. 4(*a*) to 4(*c*) show a spring.
Figure 4B:
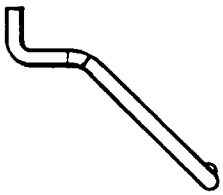
Figure 4C:
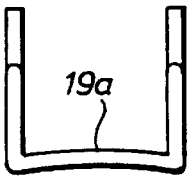
Figure 5A:
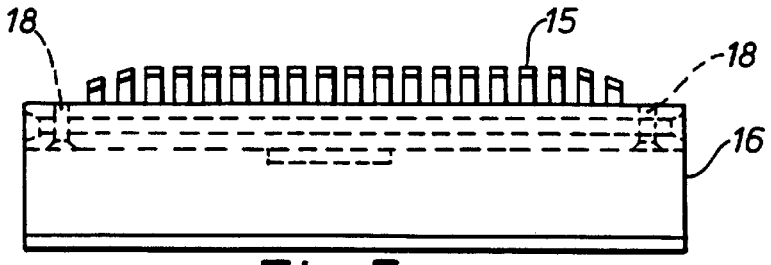
FIGS. 5(*a*) to 5(*c*) show a scraper brush.
Figure 5B:
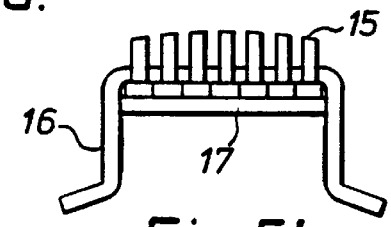
Figure 5C:
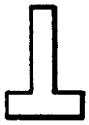
Figure 6A:
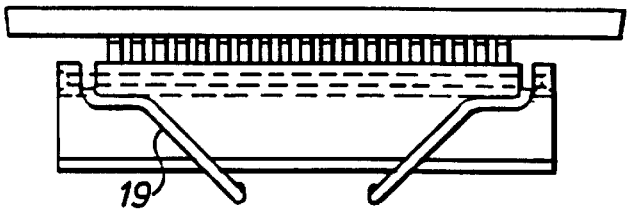
FIGS. 6(*a*) to 6(*d*) show scraper brush assemblies in situ, showing two alternative spring mountings.
Figure 6B:
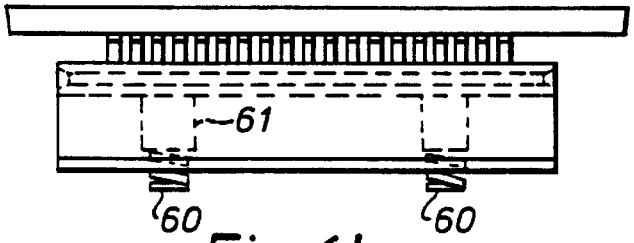
Figure 6B:
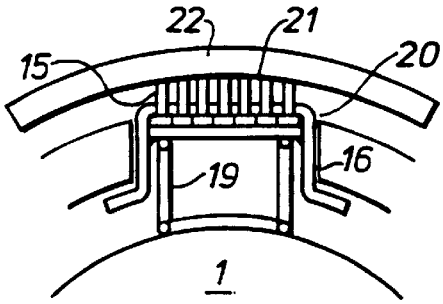
Figure 6D:
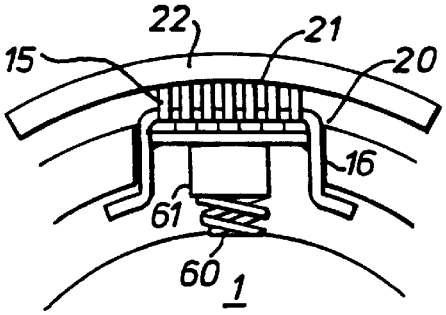

FIG. 2 shows a cross section through II—II of FIG. 1 indicating a cleaning/conditioning element retaining sleeve with four elements 12 in situ. The scraper brush assembly is more clearly shown in FIGS. 5 and 6 and comprises a plurality of pins 15 mounted in a holder 16. FIG. 5(*a*) shows a side view of a scraper brush assembly and FIG. 5(*b*) shows a front view. A plurality of pins 15 are mounted in wire holder 16 which is resilient to enable its ends 17 to be deformed to enter a brush retaining slot in a sleeve. After the pins have been secured in place a retaining plate 17 is welded into position under the pins, securing them. As shown, the pins towards the edges are formed with inclined faces to enable them better to match the internal shape of a well casing. FIG. 5(*c*) shows an individual pin. Holes 18 are drilled through each end of the pin assembly after plate 17 has been welded in place. Two springs 19, as shown in FIG. 4, are then placed into these holes, as shown in FIG. 6(*a*). FIG. 4(*a*) shows a plan view of a spring which is generally U-shaped in plan view. FIG. 4(*b*) is a side view showing that the spring extends downwards from each end, is bent outward through 90° and is then bent back at approximately 45°. The central portion 19*a* of the spring is arcuate as shown in the elevation view of FIG. 4(*c*) to match the contour of the mandrel.

FIG. 6(*b*) shows the scraper brush assembly in situ. Wire holder 16 is mounted within a slot 20 of sleeve 5, 6, 7, 8 or 9 so that the bottom of a spring 19 rests against mandrel 1. The pins 15 are dimensioned so that they make contact with the internal surface 21 of a casing 22. Thus, as the tool is displaced the pins clean casing 22. It is seen that, if the tool is to be used on a casing of different internal diameter, it is an easy matter to replace each brush assembly with one in which the pins are longer or shorter, or differently positioned, to match the casing diameter.

As shown in FIG. 6(*a*), the elements are preferably mounted such that the outside diameter of the tool is greater than the inner diameter of the casing, so that the elements are compressed in situ, and outwards force is applied by the mandrel.

FIGS. 6(*c*) and 6(*d*) show an alternative embodiment in which the shaped springs 19 are replaced by one or more coil springs 60, mounted in steel tubes 61 so as to protrude therefrom. One end of the or each coil spring is mounted to the welded plate 17 and the other end rests against mandrel 1, providing radially outwards pressure pushing the pins 15 into contact with the well casing.

Combinations of springs, or other resilient elements, may be used if desired. For example, springs 19 could be used in combination with one or more coil springs 60. Other types of springs or resilient means may be used.

Figure 3:
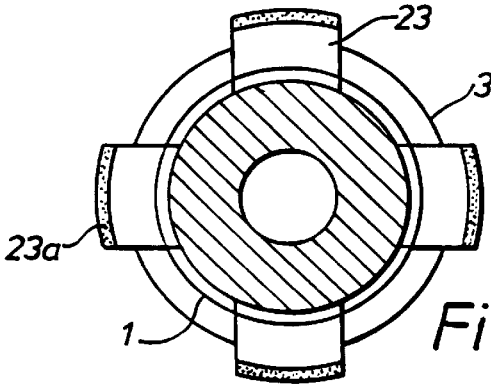
FIG. 3 shows a cross section through III—III of FIG. 1.
Figure 7A:
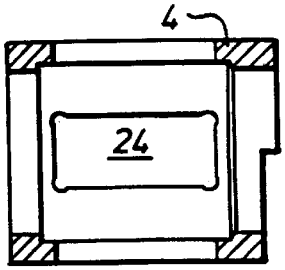
FIGS. 7(*a*) and 7(*b*) show a lower stabilizer sleeve.
Figure 7B:
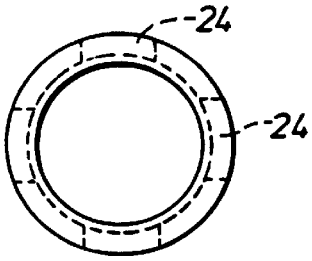

FIG. 3 shows a cross section through III—III of FIG. 1 showing the stabilizer sleeve 3 around mandrel 1. A plurality of angularly spaced stabilizer inserts 23 are inserted into slots on sleeve 3. In this embodiment, four inserts 23 are provided, spaced by 90°. The size of these inserts is determined, inter alia, by the actual internal diameter of the well casing so that the stabilizer inserts can precisely match the diameter for accurate stabilization. It is a simple matter to replace a set of stabilizer inserts (pads) by another, larger, set for example to accommodate a larger internal-diameter pipe. The outer surface of each stabilizer insert is curved to match the internal curvature of a well casing and is made of a hard material such as a metal, typically hard surfaced with tungsten carbide inserts 23*a* of dimensions 25 mm long, 5 mm wide and 3 mm deep set in a tungsten carbide matrix. Preferably, all the inserts for each stabilizer sleeve are made from one machined ring, the parts of the ring between the stabilizer portions being cut off and discarded or re-used. The stabilizer inserts are secured into slots 24 of each stabilizer sleeve. The slots are shown in FIGS. 7(*a*) and 8(*b*). They may be secured by screwing into the corners of slot 24.

Figure 8A:
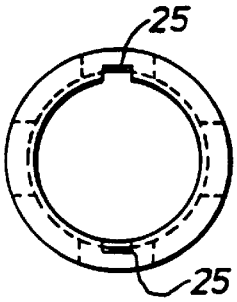
FIGS. 8(*a*) to 8(*c*) shown an upper stabilizer sleeve.
Figure 8B:
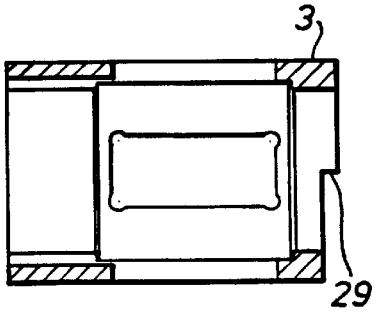
Figure 8C:
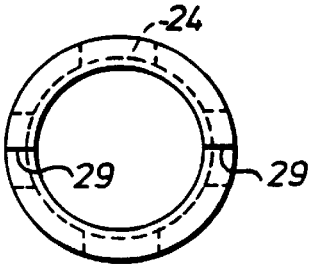

FIG. 7(*a*) shows a longitudinal cross-section through lower stabilizer sleeve 4 and FIG. 7(*b*) shows an end view illustrating, in dashed lines, the slots and channels. FIGS. 8(*a*) to 8(*c*) illustrate the upper stabilizer sleeve. FIG. 8(*a*) is an upper end view illustrating slots 24 in dashed lines and also two finite grooves 25 forming a keyway for cooperating with the keyway 10 of the mandrel 1.

Figure 13:
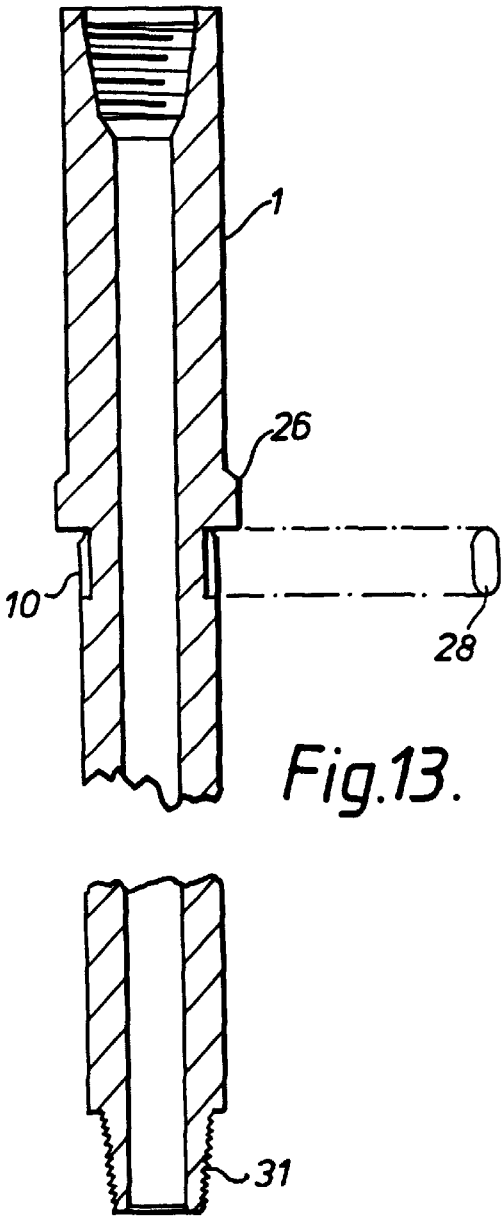
FIG. 13 shows a mandrel and key.

The mandrel itself is shown more clearly in FIG. 13. The mandrel has an enlarged shoulder 26 before a rectangular keyway 10. A key 28 locates between this keyway and the keyway formed by a groove 25 of the upper stabilizer shaft to retain the upper stabilizer shaft in place and prevent it from rotating with respect to the mandrel. In use, upper stabilizer shaft 3 is slid over the mandrel from the bottom until it abuts against shoulder 26 and the keyways engage.

In some tools it may be necessary, to maintain tool integrity, to machine or otherwise form one or more drive faces or lugs in the shoulder 26, for abutting against drive faces in the upper stabilisation elements, instead of or in addition to the mechanism of the keyways. These may form axially disposed abutment surfaces.

Figure 9A:
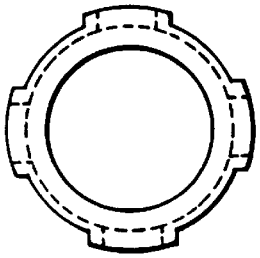
FIGS. 9(*a*), (*b*) and (*c*) show an end conditioning/cleaning element retaining sleeve.
Figure 9B:
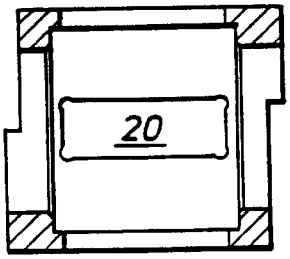
Figure 9C:
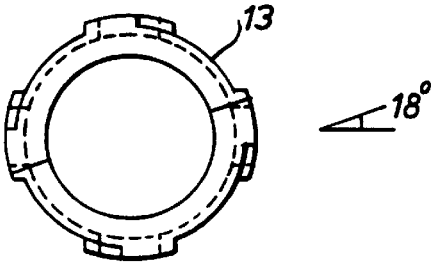
Figure 10A:
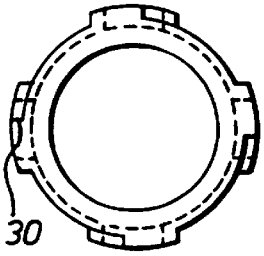
FIGS. 10(*a*), (*b*) and (*c*) show an intermediate conditioning/cleaning element retaining sleeve.
Figure 10B:
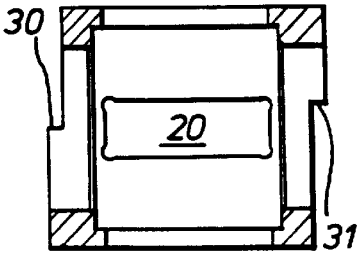
Figure 10C:
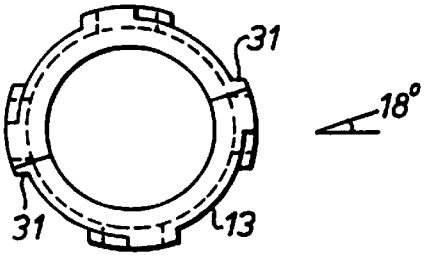

At the lower surface of the upper stabilizer sleeve 3, a driving face 29 is formed. This is formed by cutting away a semi-circular portion of the surface by a particular depth, say 25 mm. This leaves an abutment surface 29 parallel to the longitudinal axis of the tool, and against which a corresponding driving surface 30, on one of the end brush retaining sleeve 5 abuts. Surface 30 is shown in FIG. 10(*b*). When the mandrel 1 is rotated, the upper stabilizer sleeve also rotates with mandrel by virtue of the keyway, and the driving surface 29 causes the first brush retaining sleeve 13 also to turn. None of these parts can turn independently. Each successive end of a brush retaining sleeve 5, 6, 7, 8 and 9 also has a drive face surface as shown at 31 for example in FIG. 9(*b*) formed by a face parallel to the longitudinal axis of the tool.

Figure 11:
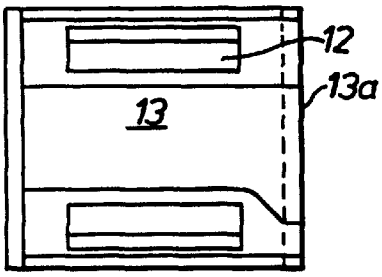
FIG. 11 shows a side view of the sleeve of FIGS. 9(*a*) to (*c*)
Figure 12:
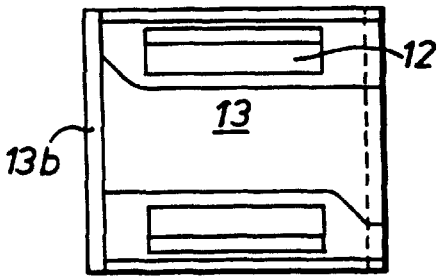
FIG. 12 shows a side view of the sleeve of FIGS. 10(*a*) to 10(*c*)

Drive face 31 shown in FIG. 10(*b*), is angularly displaced from surface 30 by a chosen amount, in this case 18°, from driving face 30. The same applies to each of the brush retaining sleeves where the two respective drive faces at each end are angularly displaced. This improves the performance of the tool by firstly avoiding each of the drive faces being along a single line which may tend to shear more easily and secondly by enabling the same design to be used for each of the end brush retaining sleeves and also a single design to be used for each of the intermediate brush retaining sleeves. Only the different angled drive faces need to be separately cut-away after manufacture. The channels 13 are shaped and spaced so that an angular displacement of 18° between adjacent sleeves automatically lines up the channels so that they are continuous and form the helical pattern described. FIGS. 11 and 12 are schematic side views of respectively an end stabilization sleeve and an intermediate stabilization sleeve. The figures show clearly the channels 13 and the slots for receiving the brushes 12. If the sleeve of FIG. 12 is rotated about its longitudinal axis by 18°, then the end 13*a* of one channel will lie in register with the end 13*b* of the second channel. It is seen how each of the end brush retaining sleeves may be identical, other than the cut out drive faces. Similarly, each of the intermediate brush-retaining sleeve may be identical other than the cut-outs. This clearly facilitates easier manufacture, requiring less moulds or dies.

Of course, the angular displacement between adjacent drive faces need not be 18 ° but could be other angles. There may be more or less than five stabilization sleeves or more or less than four brush assemblies on each sleeve. 18 ° is preferably chosen for a system having five cleaning sleeves since over the five sleeves the total rotation is 90°, thus ensuring total coverage over 360 ° for four equiangularly-spaced elements.

On some tools, particularly smaller diameter ones, it may not be appropriate to use drive faces cut-away from the sleeve to drive adjacent sleeves, particularly where it might reduce tool integrity. In these cases, other driving methods may be used. For example, keyways, lugs or splines may be formed in the mandrel which are elongate and run down substantially the entire length of the mandrel. Plain-ended sleeves can then be used which have keyways machined at different angles which locate at their respective different angles in the elongate mandrel keyways, lug or spline to provide angular displacement of adjacent sleeves. Alternatively, similar keyways may be used to those of FIG. 1, but each set is dedicated to a single sleeve and are angularly and axially displaced to provide correct spacing for that sleeve. In these examples, orientation is achieved by forming (eg milling) keyways, lugs or inserts at different angular displacements on the sleeves.

The present invention allows for easy replacement of the various types of insert. Thus, the composition, profile, shape, material or other physical characteristics of the cleaning or conditioning elements can be chosen for each application of the tool to suit the type of casing or tubing being treated. High chromium casings, for example, may not be cleaned or treated with tools having metal contact surfaces. Conditioning or cleaning elements and stabilizer elements may be formed of any material, such as various metals, alloys, plastics materials, ceramic materials, composite materials, rubber, fibre, textile materials or combinations of these for example. Furthermore, the cleaning elements need not be pins but may be other types of elements, for example blades, fingers, differently shaped or profiled pins or other shapes. They may be of optimised profiles and/or in optimised orientation with respect to the tool. One example is of rectangular flat steel strips bonded to a rubber or other resilient backing block.

More than one row of elements may be present on each sleeve, or only one sleeve may be provided having a plurality of rows of elements. In these cases, the elements in adjacent rows in a single sleeve may be offset. A single sleeve may include both conditioning and stabilization elements, usually in different axially displaced rows.

Figure 14:
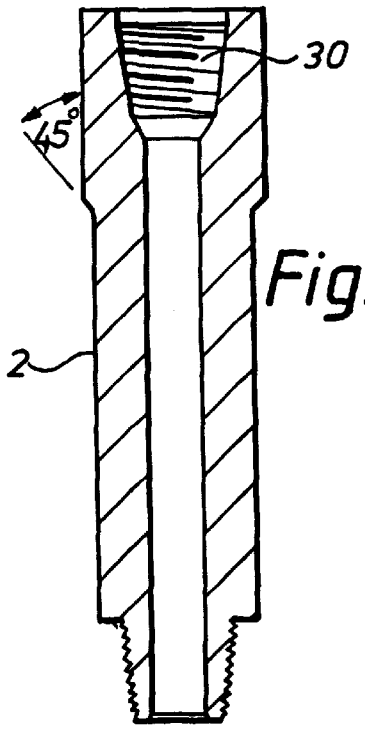
FIG. 14 shows a lower subshaft.

FIG. 14 shows the lower subshaft 2 and indicates more clearly the box 130 which cooperates with pin 31 of the mandrel 1 to form a conventional pin and box threaded API or other types of threaded construction. In one example, the diameter of this will be 4.5 inches (11.4 cm).

Figure 15:
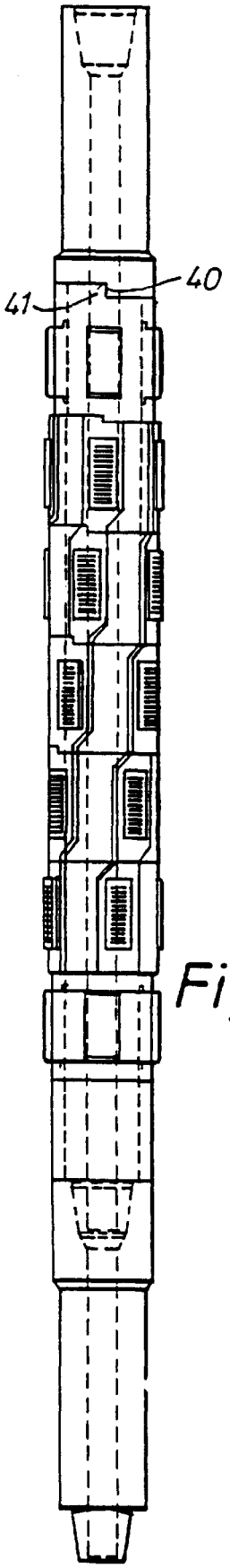
FIG. 15 shows an alternative embodiment of a well cleaning or conditioning tool.

FIG. 15 shows an alternative embodiment of the tool in which, instead of keyway 10, the mandrel is itself formed with a drive face 40, which abuts a drive face 41 on the first stabilizer sleeve. This avoids the need for a keyway arid may improve the structural integrity of the tool, in addition to improved prevention of relative rotation between the mandrel and the various sleeves mounted upon it.

Figure 16:
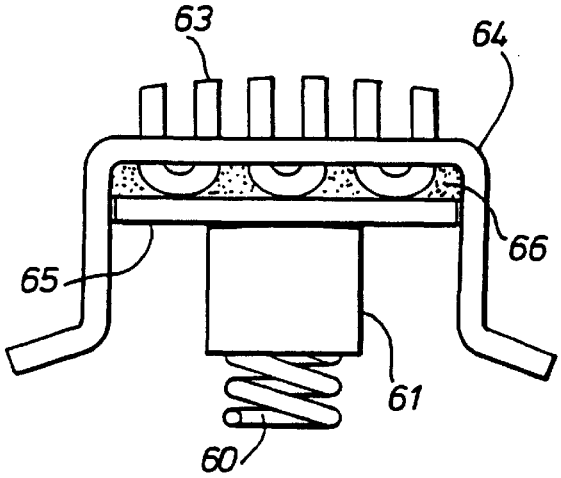
FIG. 16 shows an alternative embodiment of a scraper brush.

FIG. 16 shows an alternative brush scraper assembly. This embodiment includes one or more springs 60 and spring housings 61, similar to that of FIGS. 6(*c*) and 6(*d*). The conditioning elements in this embodiment are U-shaped elements 63 of any material suitable for scraping or otherwise conditioning the inside of a well. The elements are mounted in an upturned fashion in a housing 64, to rest on a backplate 65. They are securely held in place by an infill of a filler material 66. As shown, the edges of the U-shaped elements are profiled to match the inner profile of a well in which the tool is used.

Figure 17:
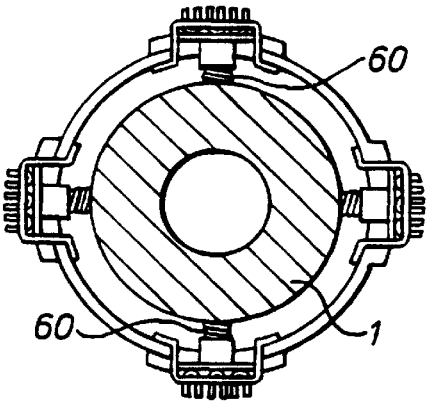
FIG. 17 shows in cross-section the scraper brush of FIG. 16 mounted on a mandrel.

FIG. 17 is a drawing similar to that of FIG. 2, showing a conditioning element bearing the scrapers of FIG. 16, in situ. The figure clearly shows how each spring 60 acts against the mandrel 1 to exert an outward force on the scraper elements to urge them into contact with a well casing.

The springs, or other resilient means, in embodiments of the invention, may provide a predetermined contact loading for the conditioning and/or stabilization elements and are selected accordingly, or their tension, compression or other parameters adjusted accordingly.

We claim:

1. A tool for conditioning the interior of a tubular structure, comprising, in combination:

a) a mandrel for connection to a workstring;

b) a plurality of interlocking sleeves mounted end to end along at least part of the length of said mandrel;

c) at least one of said sleeves bearing conditioning elements;

d) at least one stabilization element distinct from said conditioning elements for stabilizing the attitude of said tool with respect to said tubular structure; and e) means for preventing relative rotation between the sleeves and the mandrel, so that, as said mandrel rotates, said sleeves rotate therewith.

2. A tool as defined in claim 1 wherein each stabilization element is engaged to a sleeve.

3. A tool as defined in claim 2 further including:

a) stabilization elements being engaged to two stabilizing element sleeves; and b) each sleeve bearing a conditioning element being mounted along said mandrel between said stabilization element sleeves.

4. A tool as defined in claim 2 wherein the positions of said sleeves bearing conditioning elements and said sleeves bearing stabilization elements are interchangeable along side mandrel.

5. A tool as defined in claim 1 wherein at least one of said sleeves is mounted to said mandrel by means of a keyway for preventing relative rotation.

6. A tool as defined in claim 1 wherein at least one of said sleeves is mounted to said mandrel by means of a drive face for preventing relative rotation.

7. A tool as defined in claim 6 wherein abutting faces of adjacent sleeves include drive faces.

8. A tool as defined in claim 7 wherein:

a) said mandrel includes a drive face; and b) said drive face of said mandrel acts against a cooperating drive face on a first one of said sleeves.

9. A tool as defined in claim 6 wherein:

a) said drive faces comprise cut-away sections of the ends of said sleeves; and b) said cut-away sections form drive faces in a plane parallel to the axial direction of said tool.

10. A tool as defined in claim 9 wherein drive faces located at opposed ends of a sleeve are angularly displaced from each other by a predetermined angular amount.

11. A tool as defined in claim 10 further including:

a) five conditioning element-sleeves; and b) said angular displacement is 18 degrees.

12. A tool as defined in claim 1 wherein:

a) said conditioning elements comprise cleaning elements; and b) a plurality of said elements is associated with each cleaning element bearing sleeve.

13. A tool as defined in claim 12 further characterized in that axially adjacent cleaning elements are off-set along the length of said tool to form a generally helical arrangement whereby full 360 degree coverage of the inside of said tubular structure is obtained as said tool is axially displaced therein.

14. A tool as defined in claim 13 further including:

a) channels are located between said cleaning elements of each sleeve; and b) said channels being connected across adjacent sleeves to form a substantially continuous, substantially helical channel for passage of fluid between the cleaning elements.

15. A tool as defined in claim 1 wherein:

a) said tubular structure includes an internal diameter; and b) each stabilization element is dimensioned to accurately match said internal diameter of said tubular structure.

16. A tool as defined in claim 1 wherein said elements are resiliently mounted within a rigid sleeve.

17. A tool as defined in claim 16 wherein at least one element is resiliently mounted within a sleeve by at least one spring that acts against said mandrel to urge said at least one element into engagement with the interior of a tubular structure in situ.

18. A tool as defined in claim 17 wherein said at least one spring provides a predetermined contact loading force.

19. A tool as defined in claim 1 wherein each conditioning element comprises at least one pin.

20. A tool as defined in claim 1 wherein said elements are interchangeable and replaceable.

21. A tool as defined in claim 1 further including:

a) a sub-shaft mounted to one end of said mandrel; and b) a spacer sleeve mounted adjacent the end of said mandrel which is connected to said sub-shaft.

22. A tool as defined in claim 1 wherein said elements are fabricated of material chosen from the group consisting of metal, alloy, plastics, rubber, composites and fibers.

23. A tool as defined in claim 1 wherein:

a) said conditioning elements comprise a housing;

b) a plurality of conditioning inserts is mounted to protrude from said housing; and c) said inserts are selected in accordance with a predetermined profile, composition and/or pattern.

24. A tool as defined in claim 23 wherein said inserts are of U-shaped cross-section.

25. A tool as defined in claim 24 wherein said inserts are mounted on a spring-loaded base to protrude from said housing.

26. A tool as defined in claim 1 wherein each stabilization element is engaged to said mandrel.

27. A tool as defined in claim 1 wherein at least one of said sleeves is mounted to said mandrel by means of a lug for preventing relative rotation.

28. A tool as defined in claim 1 wherein each conditioning element comprises at least one blade.

29. A tool as defined in claim 1 wherein each conditioning element comprises at least one finger.

* * * * *